US009157407B2

(12) United States Patent
Acuna et al.

(10) Patent No.: US 9,157,407 B2
(45) Date of Patent: Oct. 13, 2015

(54) STARTING SYSTEM FOR INTERNAL COMBUSTION ENGINE

(75) Inventors: Travis Acuna, Gilbert, AZ (US); John Payne, Chandler, AZ (US); Matt Pientka, Chandler, AZ (US)

(73) Assignee: MTD Products Inc, Valley City, OH (US)

( * ) Notice: Subject to any disclaimer, the term of this patent is extended or adjusted under 35 U.S.C. 154(b) by 413 days.

(21) Appl. No.: 13/704,647

(22) PCT Filed: Jul. 28, 2011

(86) PCT No.: PCT/US2011/001329

§ 371 (c)(1),
(2), (4) Date: Jan. 21, 2013

(87) PCT Pub. No.: WO2012/015477

PCT Pub. Date: Feb. 2, 2012

(65) Prior Publication Data

US 2013/0104833 A1 May 2, 2013

Related U.S. Application Data

(60) Provisional application No. 61/368,753, filed on Jul. 29, 2010.

(51) Int. Cl.
*F02N 1/00* (2006.01)
*F02N 15/00* (2006.01)
(Continued)

(52) U.S. Cl.
CPC ..... *F02N 15/00* (2013.01); *F02D 11/02* (2013.01); *F02N 3/02* (2013.01); *F02N 19/001* (2013.01); *F02N 2019/002* (2013.01)

(58) Field of Classification Search
CPC . F02N 19/00; F02N 19/001; F02N 2019/002; F02N 3/02
USPC ..... 123/179.1, 179.3, 179.16, 185.1, 185.2
See application file for complete search history.

(56) References Cited

U.S. PATENT DOCUMENTS 2,920,612 A * 1/1960 Jones, Jr. ..... 123/179.24
3,570,464 A * 3/1971 Morabit et al. ..... 123/185.2
(Continued)

FOREIGN PATENT DOCUMENTS

DE 10 2009014347 9/2010
EP 1323916 7/2003
EP 1640592 3/2006

OTHER PUBLICATIONS

International Search Report and Written Opinion dated Jun. 19, 2012, for PCT/US2011/001329.

*Primary Examiner* — Lindsay Low
*Assistant Examiner* — Robert Werner
(74) *Attorney, Agent, or Firm* — Wegman, Hessler & Vanderburg

(57) ABSTRACT

A starting system for an internal combustion engine automatically operates a starting feature on a carburetor associated with the engine. The starting system includes a cam with a bearing mounted on the crankshaft. The bearing is secured so that its inner race will always rotate with the crankshaft. The cam has bosses on one side and is shaped such that it includes a base and a lobe with an outer surface surrounding the cam. At least one spring-loaded pawl is mounted on the flywheel. The pawl is biased to engage a cam boss so as to cause the cam to rotate with the crankshaft during a start-up process. A spring loaded rocker arm is pivotally mounted adjacent the cam. The rocker arm has a roller assembly configured to ride on the outer surface of the cam. As the cam rotates, the roller assembly riding on the cam surface is pushed outward by the cam lobe. A throttle cable is attached at a first end to the rocker arm and at its opposite end to the starting feature on the carburetor. When the roller assembly ramps up the lobe, the throttle cable is pulled into an extended position to actuate the starting feature of the carburetor.

18 Claims, 6 Drawing Sheets

(51) Int. Cl.

| | |
|---|---|
| ***F02D 11/02*** | (2006.01) |
| *F02N 19/00* | (2010.01) |
| *F02N 3/02* | (2006.01) |

(56) References Cited

U.S. PATENT DOCUMENTS

| | | | | |
|---|---|---|---|---|
| 3,597,623 | A * | 8/1971 | Gilardi | 290/40 R |
| 3,749,069 | A * | 7/1973 | Reese | 123/376 |
| 5,010,858 | A * | 4/1991 | Schierling et al. | 123/179.24 |
| 5,069,180 | A * | 12/1991 | Schmidt et al. | 123/376 |
| 5,937,819 | A * | 8/1999 | Kouchi et al. | 123/198 E |
| 6,279,522 | B1 * | 8/2001 | Balzar et al. | 123/90.1 |
| 6,722,638 | B2 * | 4/2004 | Kojima et al. | 261/39.2 |
| 8,590,509 | B2 * | 11/2013 | Yano et al. | 123/363 |
| 2004/0089259 | A1 | 5/2004 | Tharman | |
| 2005/0022798 | A1 * | 2/2005 | Roth et al. | 123/676 |
| 2013/0000586 | A1 * | 1/2013 | Zuo et al. | 123/179.16 |

* cited by examiner

STARTING SYSTEM FOR INTERNAL COMBUSTION ENGINE

CROSS REFERENCE TO RELATED APPLICATION

This application claims the priority benefit of U.S. Provisional Patent Application Ser. No. 61/368,753 filed Jul. 29, 2010.

BACKGROUND OF THE INVENTION

1. Field of Invention

The invention relates to a starting system for an internal combustion engine and, more particularly, to starting system that automatically actuates a starting feature on a carburetor on the internal combustion engine.

2. Description of Related Art

Carburetor arrangements for internal combustion engines mounted on outdoor power equipment such as power chain saws, string trimmers, brush cutters, and the like are known in general. Opening into the intake channel portion is a fuel channel that is connected with a fuel-filled storage space and that supplies fuel as a function of the underpressure in the intake channel. Since internal combustion engines that are to be started by a pull cord achieve only low starting speeds, for the start-up via a start-up mechanism the intake underpressure is increased in that for example a choke valve reduces the flow cross-section of the intake channel portion upstream of the carburetor arrangement. This ensures that even with a pull cord starter, adequate fuel is drawn in during the start-up process, so that a mixture that is capable of being ignited is made available with few starting strokes, and ensures a start-up of the internal combustion engine.

It would be desirable to provide a starting system that automatically actuates the starting feature on the carburetor to aid in starting the internal combustion engine.

SUMMARY OF THE INVENTION

The invention is directed to a starting system for an internal combustion engine for automatically operating a starting feature on a carburetor associated with the engine, the engine having a crankshaft and a flywheel mounted on the crankshaft. The starting system includes a cam with a sealed ball bearing mounted on the crankshaft. The bearing is secured so that its inner race will always rotate with the crankshaft. The cam has bosses on one side and a cam base circle and cam lobe on its outer surface. At least one spring-loaded pawl is mounted on the flywheel. The pawl is biased radially inward and configured to engage a cam boss when in an inwardly biased position so as to cause the cam to rotate with the crankshaft. A rocker arm is pivotally mounted adjacent the cam. The rocker arm has a spring loaded roller assembly configured to ride on the outer surface of the cam. As the cam rotates, the roller assembly riding on the cam surface is pushed outward by the cam lobe. A throttle cable is attached at a first end to the rocker arm and at its opposite end to the starting feature on the carburetor. When the roller assembly ramps up the cam lobe, the throttle cable is pulled into an actuated position to actuate the starting feature of the carburetor.

These and other features and advantages of this invention are described in, or are apparent from, the following detailed description of various exemplary embodiments of the systems and methods according to this invention.

BRIEF DESCRIPTION OF THE DRAWINGS

The structure, operation, and advantages of the presently disclosed embodiment of the invention will become apparent when consideration of the following description taken in conjunction with the accompanying drawings wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
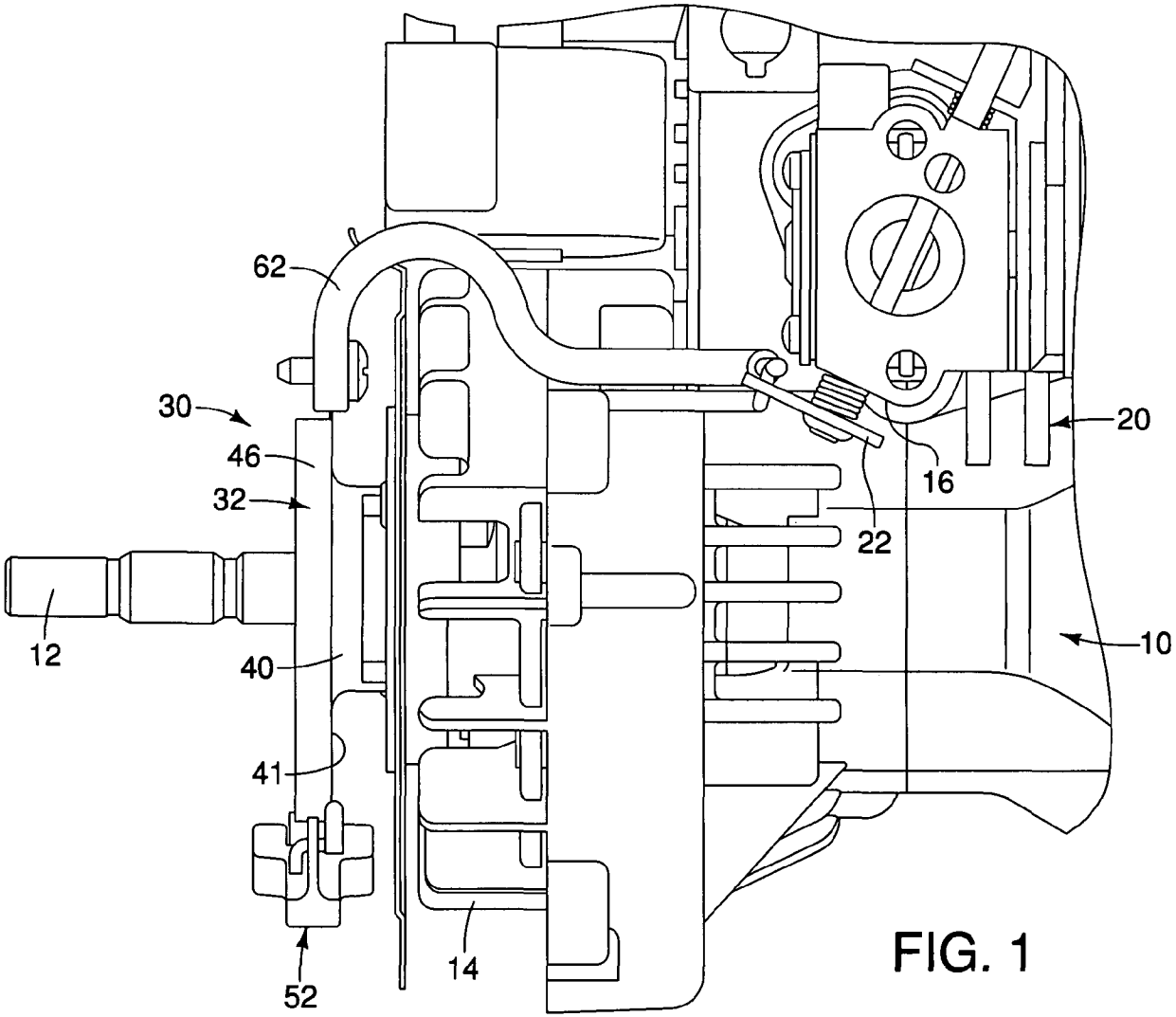
FIG. 1 is a side view of an internal combustion engine having a starting system according to the invention.

Referring now to the drawings, FIG. 1 illustrates a four-cycle internal combustion engine 10 having a typical crankshaft 12 and flywheel 14. As is known in the art, a carburetor arrangement 16 supplies fuel from a fuel supply to the internal combustion engine 10. The internal combustion engine 10 has a starting system 20 with a starting feature 22 provided to the carburetor upstream of a venturi section in its intake channel (not shown). In one embodiment, the starting feature 22 comprises a choke valve that is rotatable about a shaft. As internal combustion engines 10 and carburetors 16 having starting features 22 are known in the art, it is not necessary to provide additional discussion of these components herein. Additionally, one skilled in the art will understand that instead of the four-cycle engine 10, some other type of internal combustion engine, for example a two-cycle engine can also be provided.

Figure 2:
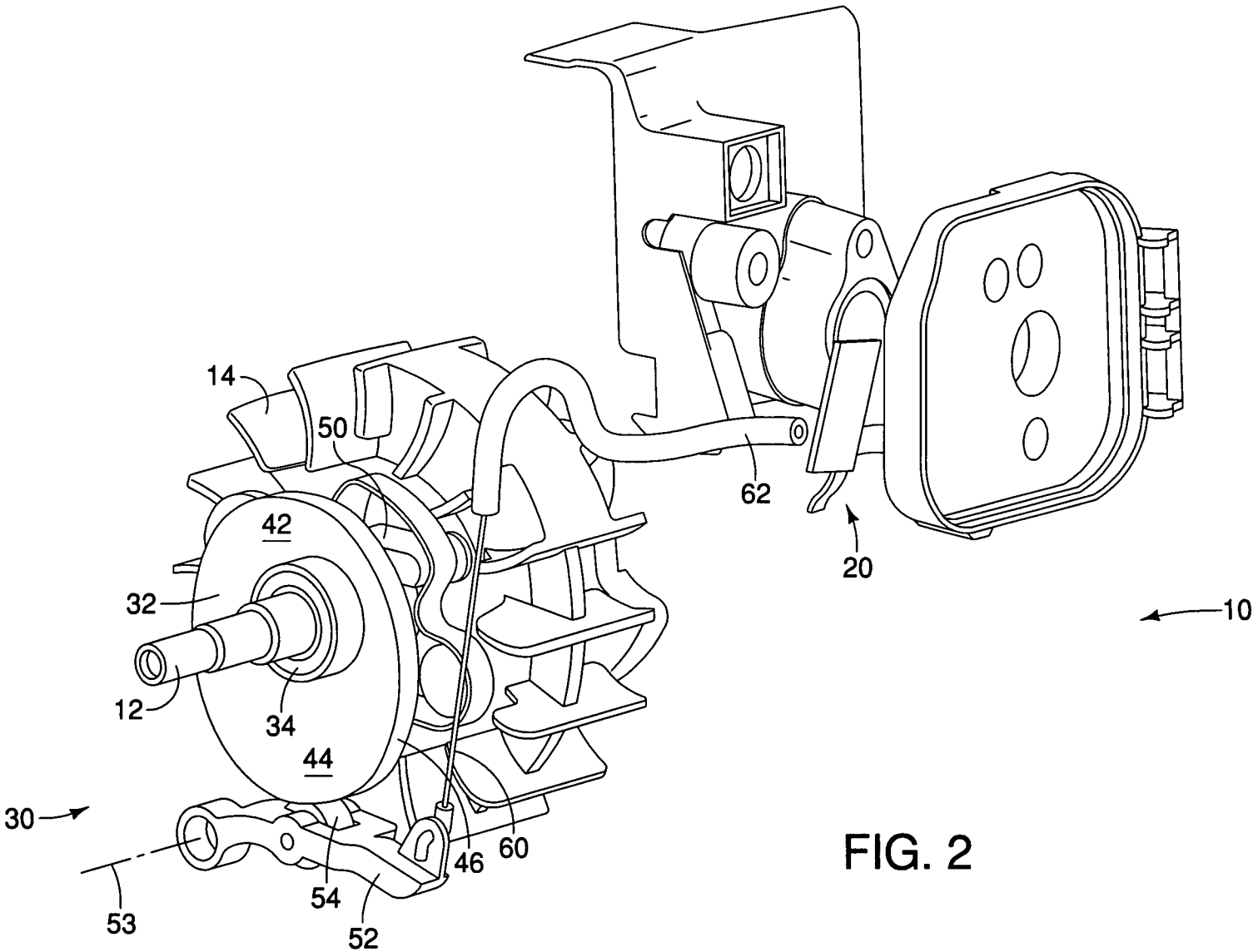
FIG. 2 is an exploded perspective of the engine of the vehicle of FIG. 1.

According to the invention, the starting system 20 of the internal combustion engine 10 includes a mechanism 30 for selectively operating the starting feature on the carburetor. Turning now to FIG. 2, a cam 32 is operatively connected to the crankshaft 12 between the flywheel 14 and clutch (not shown). A rotatable bearing 34, such as a sleeve bearing or the like, connects the cam 32 to the crankshaft 12, wherein the cam 32 is independently rotatable about the crankshaft 12 by way of the bearing 34. As such, rotation of the crankshaft 12 does not translate to rotation of the cam 32 and vice-versa, because the bearing 34 disassociates the relative rotation of both the crankshaft 12 and the cam 32 relative to each other.

Figure 3:
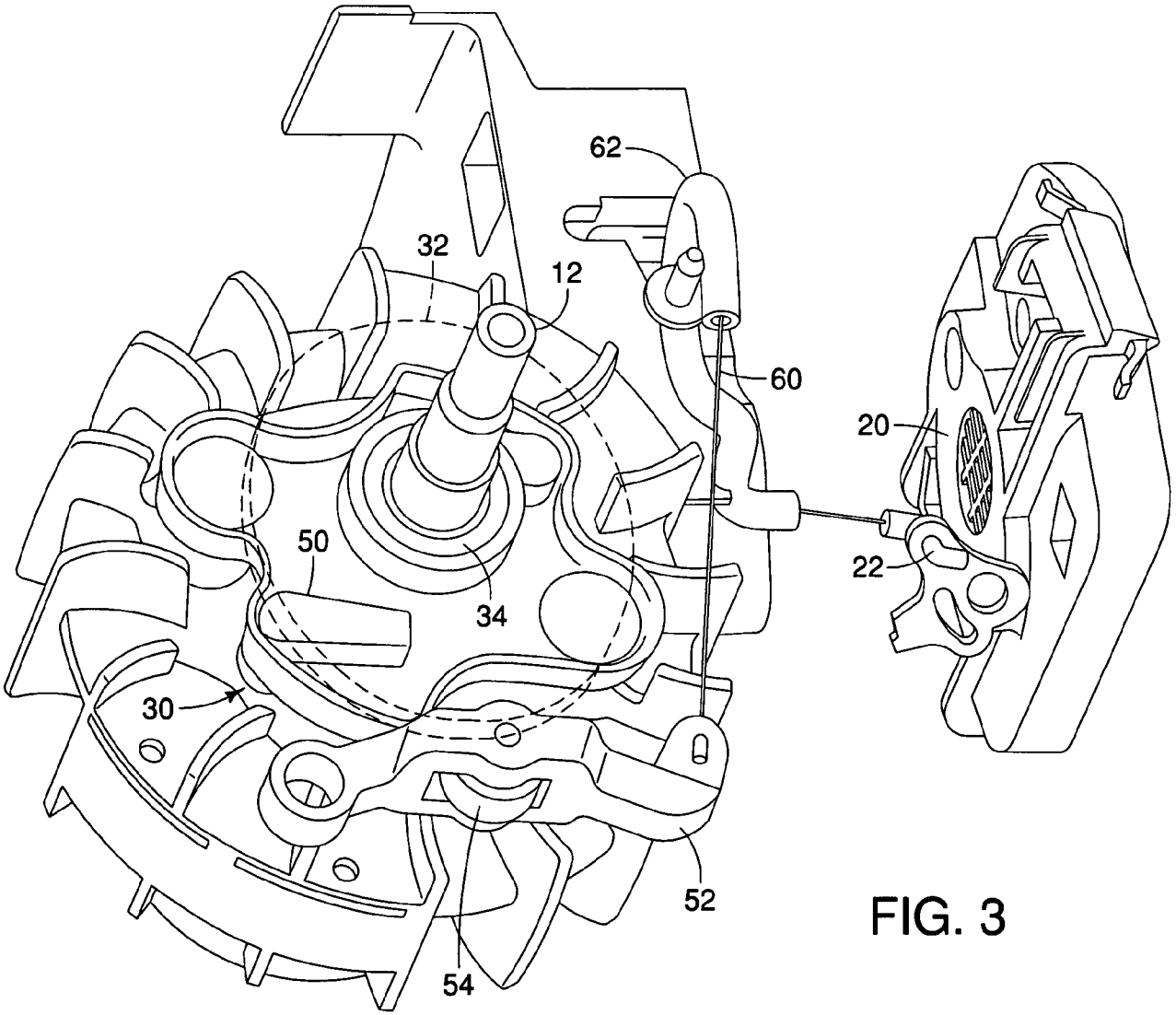
FIG. 3 is an exploded perspective of the engine of the vehicle of FIG. 1.
Figure 4:
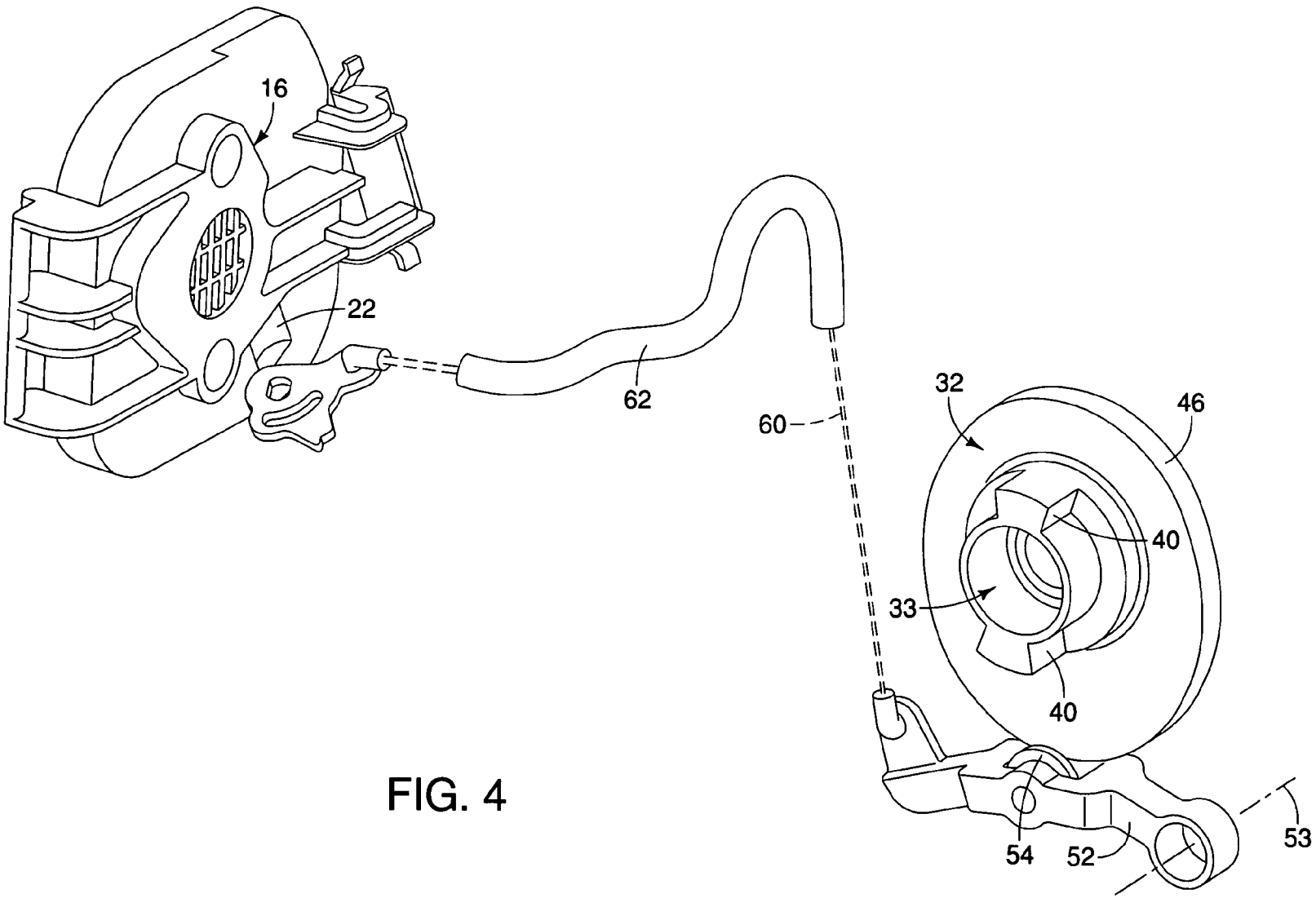
FIG. 4 is an exploded perspective of portions of the engine of the vehicle of FIG. 1 illustrating the starting mechanism.
Figure 5:
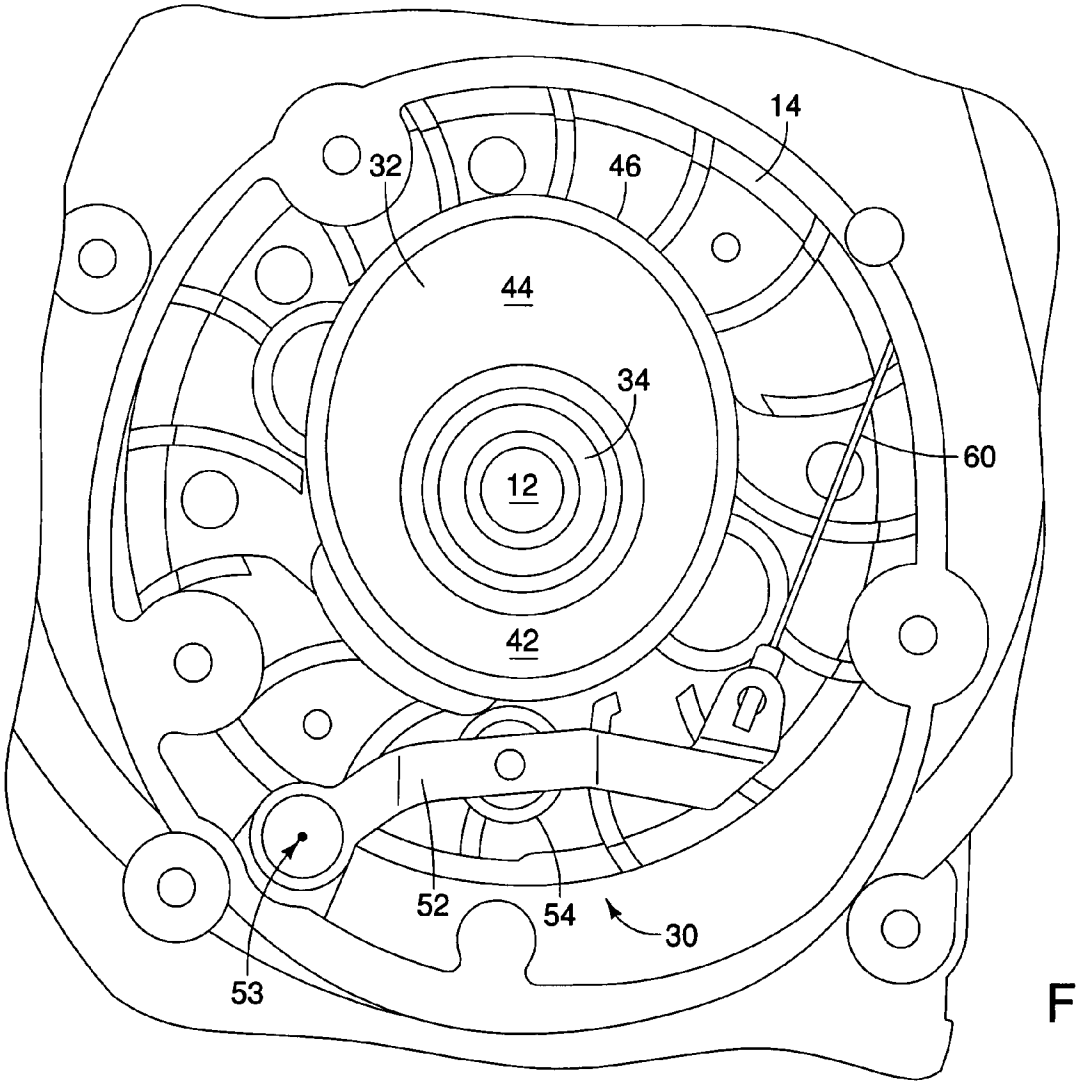
FIG. 5 is a plan view of a portion of the starting mechanism of FIG. 4 with the starting mechanism in an initial condition.
Figure 6:
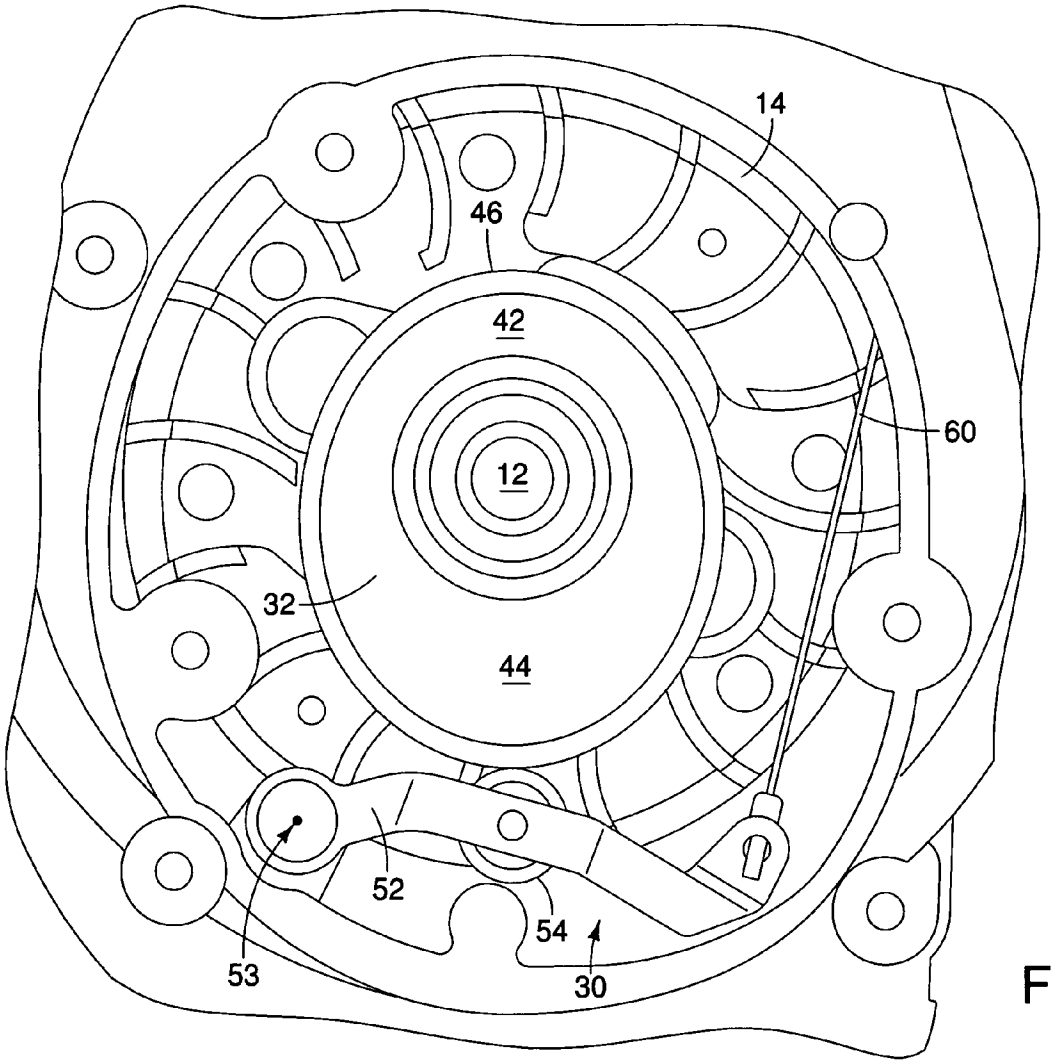
FIG. 6 is a plan view of the starting mechanism of FIG. 4 with the starting mechanism in a starting condition.

As shown in FIGS. 5-6, the cam 32 is an oblong, or egg-shaped member having an aperture 33 formed therethrough. The cam 32 has an outer surface 46 against which a spring loaded roller assembly 54 operatively attached to the rocker arm 52 contacts and travels. Due to the oblong shape of the cam 32, the cam 32 has a substantially circular base 42 and an elongated lobe 44 extending from the base 42. The outer surface 46 surrounding the base 42 and lobe 44 is directed radially outward from the aperture 33. As best seen in FIGS. 3 and 4, the cam 32 includes a plurality of bosses 40 formed on the face of the cam 32 directed toward the flywheel 14.

As shown in FIGS. 2-3, spring loaded pawls 50 are operatively connected to the flywheel 14. Spring force from springs (not shown) bias the pawls 50 away from the flywheel 14 and toward the cam 32 at low revolutions per minute (RPMs) during a start-up process. In the starting position, the pawls 50 engage the bosses 40 on a side surface 41 of the cam 32, thereby causing the cam 32 to rotate about the crankshaft 12. During the start-up process when the pawls 50 engage the bosses 40 extending from the cam 32 during low-RPM, the pawls 50 effectively connect the flywheel 14 and the cam 32 such that rotation of the flywheel 14 is directly transferred to the cam 32. As the revolutions of the flywheel 14 increase after the initial start-up process, the spring forces that previously biased the pawls 50 toward the cam 32 during low RPMs are overcome such that the pawls 50 disengage from bosses 40 on the cam 32. Thus, as the RPMs increase, the cam 32 no longer has the pawls 50 transferring rotational forces thereto so the cam 32 slows to a halt, returning to the starting position.

As shown in FIGS. 5-6, a rocker arm 52 is pivotally mounted adjacent to the cam 32, and the rocker arm 52 is pivotal between a first position (FIG. 5) and a second position (FIG. 6). The rocker arm 52 has a roller assembly 54 configured to contact and travel along the outer surface 46 of the cam 32 as the cam 32 rotates about the crankshaft 12, and the rocker arm 52 is spring loaded so as to bias the roller assembly 54 into substantially continuous contact with the outer surface 46 of the cam 32. The rotational movement of the cam 32 causes the roller assembly 54 to rotate or roll, and the movement or travel of the roller assembly 54 about the outer surface 46 of the cam 32 causes the rocker arm 52 to pivot between the first and second positions. FIG. 5 shows the cam 32 in a first position, or the starting position, wherein the roller assembly 54 is in contact with the outer surface 46 at a position adjacent to the base 42 of the cam 32. As the cam 32 rotates during the start-up process described above, the roller assembly 54 follows the outer surface 46 of the cam 32 toward the lobe 44. Because the cam 32 has an oblong shape, rotation of the cam 32 causes the roller assembly 54 to be pushed outwardly away from the crankshaft 12 by the shape of the lobe 44 of the cam 32 such that the rocker arm 52 pivots about its rotational axis 53. Once the cam 32 has rotated such that the roller assembly 54 is located in a position adjacent to the end of the lobe 44, the rocker arm 52 is pivoted to a second position such that the roller assembly 54 is located the furthest distance away from the crankshaft 12. Once the pawls 50 disengage from the cam 32, the cam 32 slows rotation until it halts such that the roller assembly 54 contacts the outer surface 46 adjacent the base 42 of the cam 32 and the rocker arm 52 is in the first position again.

A throttle cable 60 has a first end and a second end, wherein the first end is attached to the distal end of the rocker arm 52 opposite its rotational axis 53 and the second end is attached to the starting feature 22 of the carburetor 16. A cable routing tube 62 guides the cable between the rocker arm 52 and the starting feature 22. As the cam 32 rotates which causes the rocker arm 52 to pivot about its rotational axis 53, the throttle cable 60 is pulled, or extended by the movement of the rocker arm 52. Accordingly, rotation of the rocker arm 52 which pulls or extends the throttle cable 60 which results in actuation of the starting feature 22. When the rocker arm 52 is in the first position, the throttle cable 60 is retracted and the starting feature 22 is not actuated.

When the roller assembly 54 travels along the outer surface 46 such that it is adjacent to the lobe 44 of the cam 32 and the rocker arm 52 is in the second position, the throttle cable 60 is extended, thereby actuating the starting feature 22 of the carburetor 16. FIG. 6 illustrates the rocker arm 52 and throttle cable 60 in the second position with the roller assembly 54 adjacent to the lobe 44. In one embodiment, as the cam 32 rotates during the start-up process, the throttle cable 60 will retract as the rocker arm 52 pivots from the second position to the first position, but the starting feature 22 will remain in its actuated position. During the start-up process, the cam 32 makes more than one revolution, thereby causing the rocker arm 52 to continually pivot between the first and second positions which results in the throttle cable 60 extending and retracting for each successive rotation of the cam 32. Accordingly, in one embodiment, the initial rotation of the cam 32 which causes rotation of the rocker arm 52 and the extension of the throttle cable 60 results in the starting feature 22 being switched to an actuated position. Once the starting feature 22 is in the actuated position, it remains in this actuated position until the operator manually disengages the starting feature 22, such as by operating a lever or rotating a knob on the carburetor 16. As such, each subsequent revolution of the cam 32 resulting in the extension and retraction of the throttle cable 60 does not affect the starting feature 22. In an alternate embodiment, the throttle cable 60 can be incorporated with an in-line spring to cycle the starting feature 22 between actuated and non-actuated as the roller assembly 54 travels past the lobe 44 of the cam 32.

In operation, during the start-up process, the RPMs of the crankshaft 12 of the engine are sufficiently low such that the pawls 50 are biased into engagement with the bosses 40 of the cam 32, wherein rotation of the flywheel 14 is transferred directly to the cam 32 thereby causing the cam 32 also rotate about the crankshaft 12. When the engine 10 finishes the start-up process and the RPMs increase, centrifugal forces cause the pawls 50 to move outward and disengage from the cam bosses 40. Once the pawls 50 disengage, the spring loaded rocker arm 52 causes the rotation of the cam 32 to halt, thereby forcing the cam 32 into the first position with the roller assembly 54 in a position adjacent to the base 42 of the cam 32 while the flywheel 14 continues to rotate with the crankshaft 12. When the engine 10 is running, the bearing 34 pressed into the cam 32 rotates with the crankshaft 12 while the cam 32, rocker arm 52, and throttle cable 60 are stationary. In this state, the spring (not shown) of the rocker arm 52 applies sufficient force onto the cam 32 to prevent the cam 32 from rotating with the crankshaft 12.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the scope of the disclosure as defined by the following claims.

The invention claimed is:

1. A starting system (20) for an internal combustion engine (10) for automatically operating a starting feature (22) on a carburetor (16) associated with the engine (10), the starting system comprising:

a cam (32) being operatively connected to a crankshaft (12) and said cam (32) being independently rotatable relative to said crankshaft (12), and wherein said cam (32) is formed of a base (42), a lobe (44) extending from said base (42), an outer surface (46) formed about said base (42) and said lobe (44), and a plurality of bosses (40) extending from a side surface (41);

at least pawl (50) operatively connected to a flywheel (14), wherein said at least one pawl (50) is biased toward engagement with at least one of said plurality of bosses (40) extending from said cam (32);

a rocker arm (52) pivotally mounted adjacent to said cam (32), said rocker (52) arm having roller assembly (54) attached thereto, said roller assembly (54) being biased into substantially continual contact with said outer surface (46) of said cam (32);

a throttle cable (60) having a first end attached to said rocker arm (52) and a second end attached to said starting feature (22) on said carburetor (16), wherein movement of said roller assembly (54) along said outer surface (46) from a position adjacent to said base (42) to a position adjacent to said lobe (44) causes said rocker arm (52) to rotate and extend said throttle cable (60) which actuates said starting feature (22).

2. The starting system of claim 1, wherein said rocker arm (52) is spring loaded to bias said roller assembly (54) against said cam (32).

3. The starting system of claim 1 further comprising a cable routing tube (62) guiding said throttle cable (60) between said rocker arm (52) and said starting feature (22).

4. The starting system of claim 1, wherein said rocker arm (52) is pivotal between a first position in which said throttle cable (60) is in a retracted position and a second position in which said throttle cable (60) is in an extended position.

5. The starting system of claim 1, wherein the starting feature (22) must be manually disengaged.

6. The starting system of claim 1, wherein centrifugal forces cause said pawls (50) to disengage said plurality of bosses (40).

7. The starting system of claim 6, wherein when said pawls (50) disengage from said plurality of bosses (40), said rocker arm (52) returns to said first position.

8. A starting system for an internal combustion engine (10) comprising:

a cam (32) operatively connected to a crankshaft (12) of said engine (10), wherein said cam (32) includes an outer surface (46), and said cam (32) being independently rotatable relative to said crankshaft (12);

a pivotal rocker arm (52) having a roller assembly (54) attached thereto, wherein said roller assembly (54) is in substantially continuous contact with said outer surface (46) of said cam (32);

a starting feature (22) on a carburetor (16) of said engine (10);

a throttle cable (60) having a first end attached to said rocker arm (52) and a second end attached to said starting feature (22);

wherein rotation of said cam (32) causes said rocker arm (52) to pivot from a first position in which said throttle cable (60) is retracted and said starting feature (22) is non-actuated to a second position in which said throttle cable (60) is extended and said starting feature (22) is actuated.

9. The starting system of claim 8, wherein said cam (32) includes a plurality of bosses (40) extending therefrom.

10. The starting system of claim 9 further comprising at least one pawl (50) biased into engagement with at least one of said plurality of bosses (40) during a start-up process.

11. The starting system of claim 10, wherein said at least one pawl (50) is disengaged from said bosses (40) when said engine is running after said start-up process.

12. The starting system of claim 8, wherein said rocker arm (52) is spring loaded to bias said roller assembly (54) into contact with said outer surface (46) of said cam (32).

13. The starting system of claim 8, wherein said starting feature (22) remains actuated when said cam (32) continues to rotate and said rocker arm (52) pivots from said second position to said first position.

14. The starting system of claim 8, wherein said starting feature (22) switches from actuated to non-actuated when said cam (32) continues to rotate and said rocker arm (52) pivots from said second position to said first position.

15. A starting system for an internal combustion engine comprising:

a cam (32) operatively connected to a crankshaft (12) of said engine, wherein said cam (32) includes an outer surface (46), and said cam (32) being independently rotatable relative to said crankshaft (12);

a rocker arm (52) mounted adjacent to said cam (32), said rocker arm (52) being pivotable about a rotational axis, a roller assembly (54) attached to said rocker arm (52), wherein said rocker arm (52) biases said roller assembly (54) into substantially continuous contact with said outer surface (46) of said cam (32);

a throttle cable (60) having a first end attached to said rocker arm (52) and a second end attached to a starting feature (22) on a carburetor (16) of said engine (10) for switching said starting feature (22) between non-actuated and actuated;

a flywheel (14) attached to said crankshaft (12);

at least one pawl (50) operatively connected to said flywheel (14), said at least one pawl (50) being biasable into engagement with said cam (32).

16. The starting system of claim 15, wherein said at least one pawl (50) is biased into engagement with said cam (32) during a start-up process when rotation of said flywheel (14) is directly transferred to said cam (32) through said at least one pawl (50).

17. The starting system of claim 16, wherein said at least one pawl (50) is disengaged from said cam (32) when said engine (10) is running after said start-up process such that no rotation of said flywheel (14) is transferred to said cam (32).

18. The starting system of claim 15, wherein rotation of said cam (32) causes said rocker arm (52) to pivot between a first position in which said throttle cable (60) is retracted and a second position in which said throttle cable (60) is extended.

* * * * *